US007682161B2

(12) United States Patent
Mao et al.

(10) Patent No.: US 7,682,161 B2
(45) Date of Patent: Mar. 23, 2010

(54) ELECTRICAL CONNECTOR HAVING POWER TERMINALS

(75) Inventors: Yu-Hua Mao, Kunshan (CN); Zhi-Hong Fang, Kunshan (CN); Xue-Qing Zhang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/321,457

(22) Filed: Jan. 20, 2009

(65) Prior Publication Data

US 2009/0186497 A1 Jul. 23, 2009

(30) Foreign Application Priority Data

Jan. 17, 2008 (CN) ..... 2008 2 0030695 U

(51) Int. Cl.
*H01R 12/00* (2006.01)

(52) U.S. Cl. ..... 439/74; 439/660

(58) Field of Classification Search ..... 439/74, 439/83, 108, 660, 607.05, 607.07, 607.08, 439/607.09, 607.13, 607.35, 607.36, 607.37
See application file for complete search history.

(56) References Cited

U.S. PATENT DOCUMENTS

| | | | | |
|---|---|---|---|---|
| 6,390,833 | B1 * | 5/2002 | Chang | 439/108 |
| 6,638,104 | B2 | 10/2003 | Hashimoto et al. | |
| 6,672,887 | B1 | 1/2004 | Yu | |
| 7,128,581 | B2 * | 10/2006 | Igarashi et al. | 439/74 |
| 7,144,277 | B2 * | 12/2006 | Pan et al. | 439/660 |
| 7,150,645 | B2 * | 12/2006 | Huang | 439/378 |

* cited by examiner

*Primary Examiner*—Thanh-Tam T Le
(74) *Attorney, Agent, or Firm*—Andrew C. Cheng; Wei Te Chung; Ming Chieh Chang

(57) ABSTRACT

An electrical connector (100) includes an insulative housing (1) comprising an engaging portion (12) which comprises a pair of side walls (121) and a pair of end walls (122), a plurality of signal terminals (2) arranged along the pair of the side walls (121) and at least one power terminals (3) located at each end wall (122). The end wall (122) defines at least one groove (120) extending along a mating direction at an outside thereof to receive and retain the at least one power terminal (3).

11 Claims, 4 Drawing Sheets

ELECTRICAL CONNECTOR HAVING POWER TERMINALS

BACKGROUND OF THE INVENTION

1. Field of the Invention

The present invention relates to an electrical connector, especially to an electrical connector having power terminals.

2. Description of the Related Art

U.S. Pat. No. 6,638,104 issued on Oct. 28, 2003, discloses an electrical connector including a housing, a plurality of signal contacts and power contacts received in the housing. The housing is provided with a pair of longitudinal side walls and a pair of end walls connecting with ends of the longitudinal side walls. The signal contacts and the power contacts are all arranged on the side walls. The electrical connector further defines a pair of guide posts formed by protruding from the end walls of the housing for guiding a mating connector to mate with the electrical connector.

However, the signal contacts and the power contacts on the same longitudinal side wall of the housing are arranged in line, so the length of the connector along the longitudinal direction would increase and the mounting area of the connector on the PCB will also increase.

Therefore, an improved electrical connector is desired to overcome the disadvantages of the related arts.

SUMMARY OF THE INVENTION

An object of the present invention is to provide an electrical connector with smaller dimension, which has power terminals.

In order to achieve above-mentioned object, an electrical connector in accordance with a preferred embodiment of the present invention includes an insulative housing comprising an engaging portion which comprises a pair of side walls and a pair of end walls, a plurality of signal terminals arranged along the pair of the side walls and at least one power terminals located at each end wall. The end wall defines at least one groove extending along a mating direction at an outside thereof to receive and retain the at least one power terminal. So the electrical connector has smaller dimension especially at the longitudinal direction.

Other objects, advantages and novel features of the invention will become more apparent from the following detailed description of the present embodiment when taken in conjunction with the accompanying drawings.

DETAILED DESCRIPTION OF THE INVENTION

Figure 1:
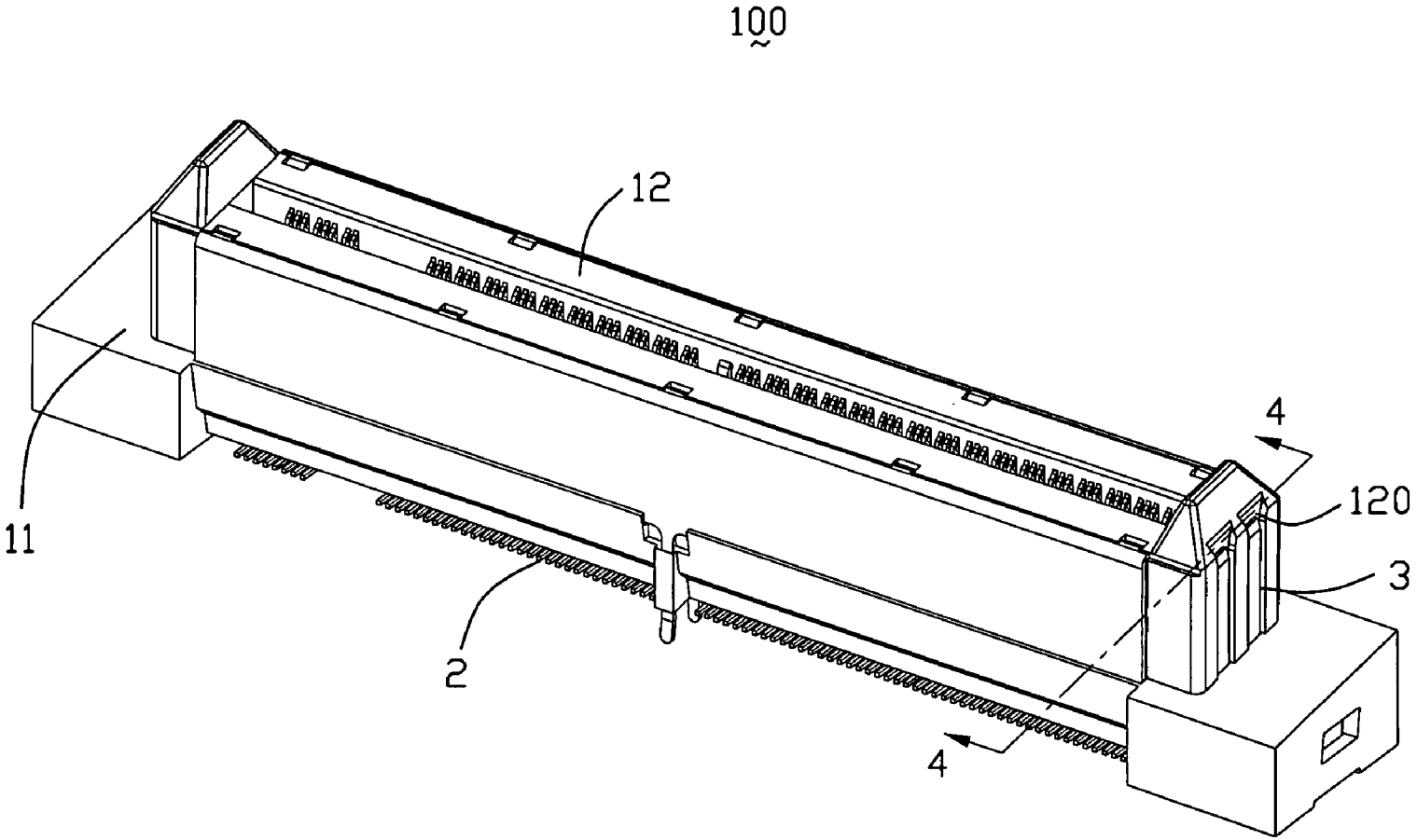
FIG. 1 is a perspective view of an electrical connector in accordance with the preferred embodiment of the present invention.

Reference will now be made to the drawing figures to describe the preferred embodiment of the present invention in detail.

Figure 2:
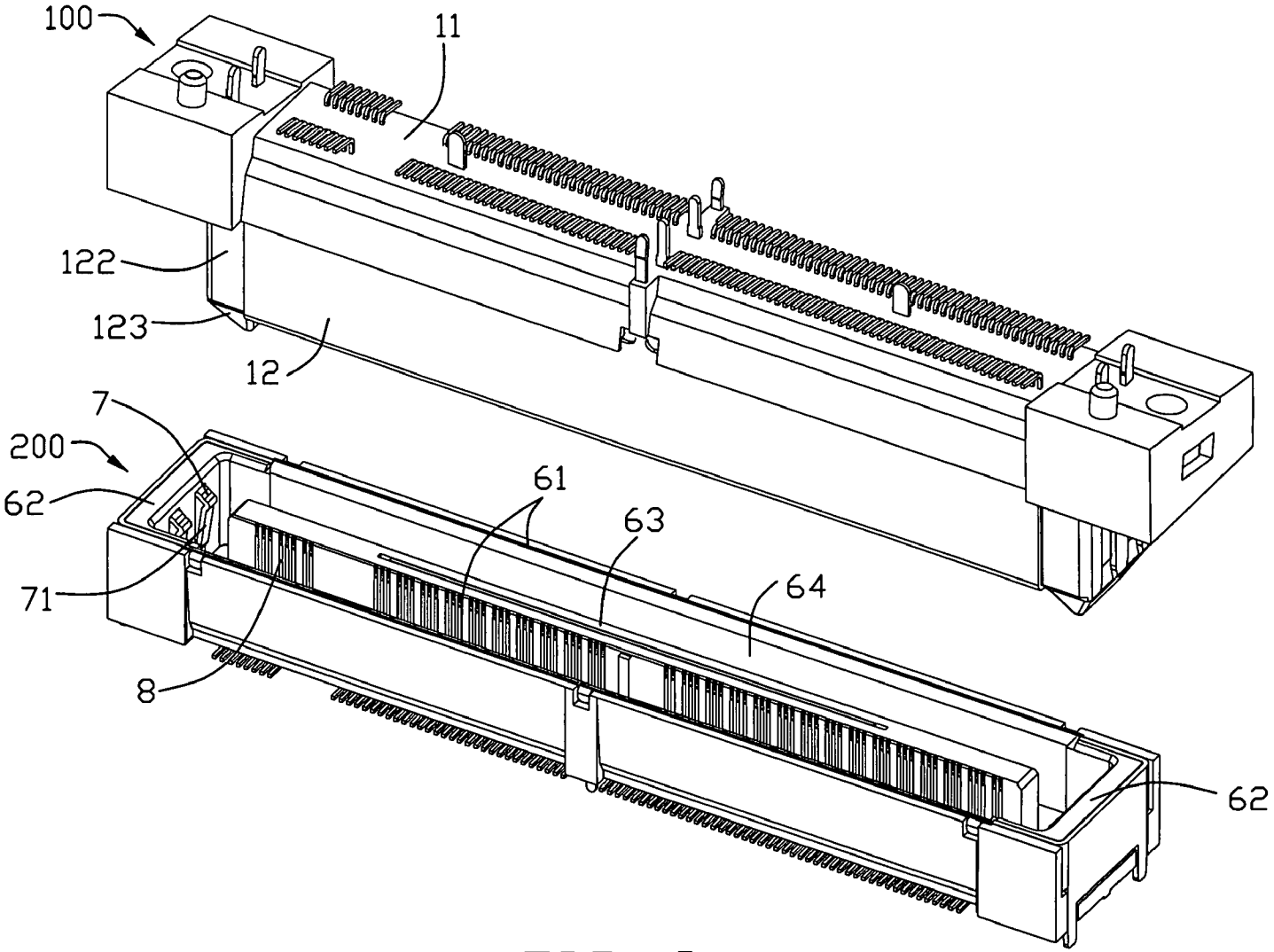
FIG. 2 is a perspective view of the electrical connector of FIG. 1 viewed from a bottom surface of the electrical connector and a mating connector for engaging with the electrical connector of FIG. 1.
Figure 3:
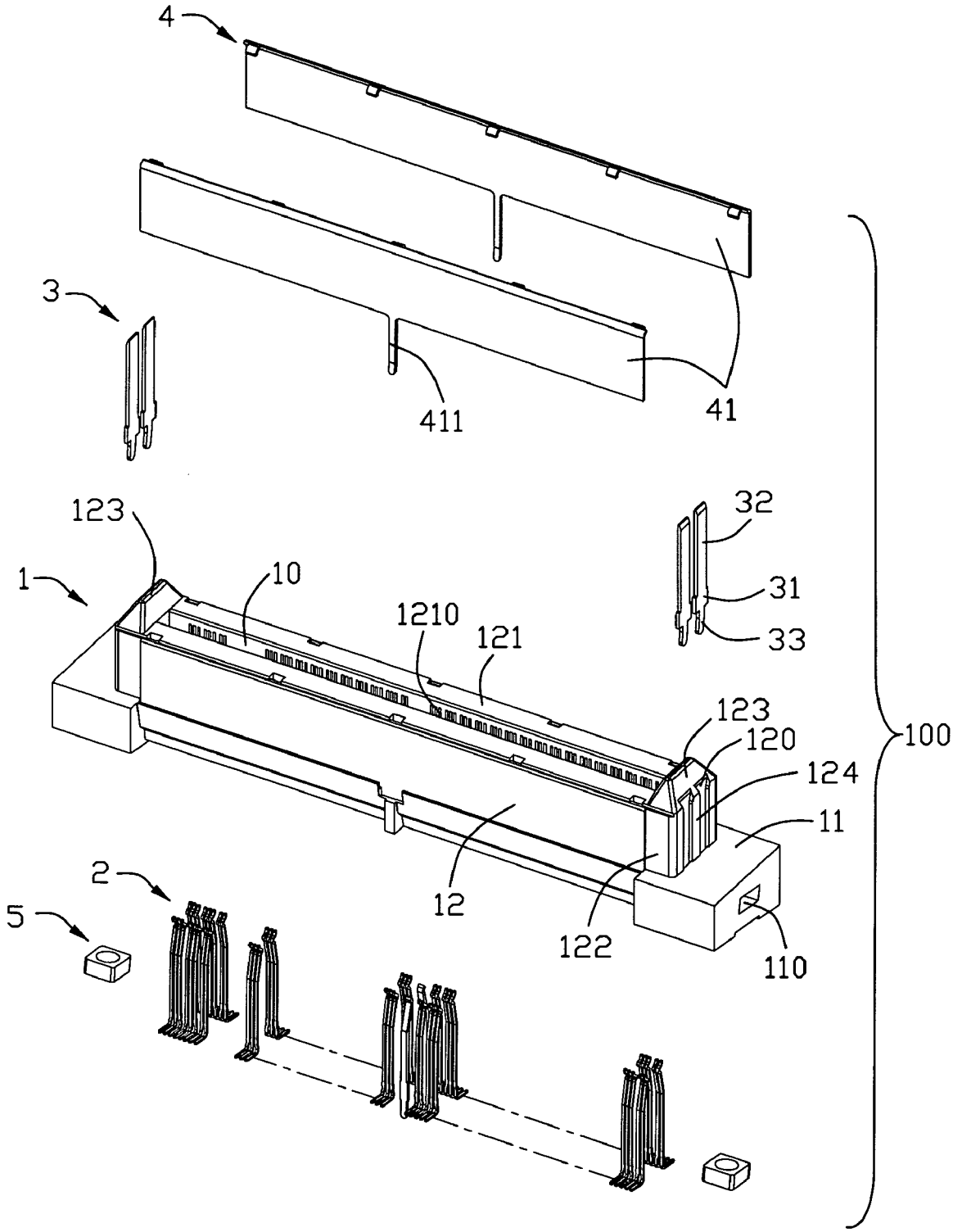
FIG. 3 is an exploded perspective view of the electrical connector of FIG. 1.

Referring to FIGS. 1, 2 and 3, an electrical connector 100 in accordance with the present invention includes an insulative housing 1, a plurality of signal terminals 2, a plurality of power terminals 3 retained in the insulative housing, a metallic shell 4 shielding the insulative housing and a pair of nuts 5 received in the insulative housing. Moreover, a mating connector 200 adapted to mate with the electrical connector 100, is shown in FIG. 2.

Referring to FIG. 3, the insulative housing 1 is provided with a base portion 11 and an engaging portion 12 upwardly extending from the base portion. The engaging portion 12 includes a pair of longitudinal side walls 121 and a pair of end walls 122 integrally connecting with two ends of the side walls, thereby forming a receiving space 10 for receiving a corresponding a mating tongue portion of the mating connector. Each of the side walls 121 defines a plurality of upright passageways 1210 arrayed along a longitudinal direction thereof for retaining and receiving the signal terminals 2, and the passageways 1210 communicate with the receiving space 10. The end walls 122 define a guiding portion 123 integrally projecting upward from the top of thereof and being cone-shaped for guiding the electrical connector 100 to mate with the mating connector. The end wall and the guiding portion are defined as a guiding post as a whole, which is shorter than the base portion 11 along the longitudinal direction.

Figure 4:
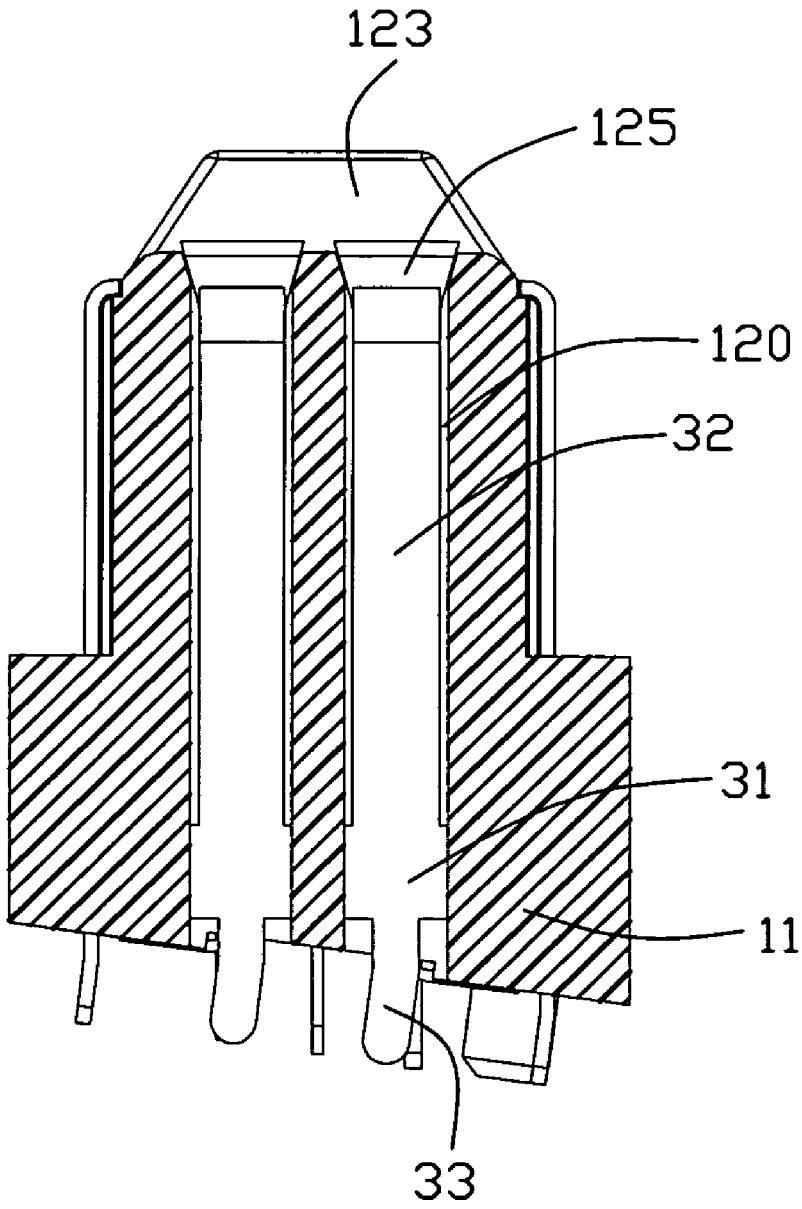
FIG. 4 is a cross-section view of the electrical connector taken along line 4-4 of FIG. 1.

Each of the guiding posts defines two grooves 120 extending along a mating direction with a partition portion 124 therebetween at the outsides thereof. The grooves 120 run through the top and the outside face of the guiding post for receiving and retaining the power terminals 3. Referring to FIG. 4, the grooves 120 extend downward through the base portion 11. Each of the grooves 120 includes a larger guiding opening 125 at the tip thereof for guiding corresponding power terminals of the mating connector to be inserted into the groove.

Referring to FIGS. 2 and 3, each of the blade-shaped power terminals 3 is provided with a retaining portion 31, a contacting portion 32 extending upwardly from one end of the retaining portion and a tail 33 extending downwards from another end of the retaining portion. The grooves 120 are swallow-tailed shaped by the partition portion 124 and the contacting portions 32 are totally embedded in the corresponding grooves 120 without lateral exposure beyond an end face of the end wall, so that the power terminals 3 are avoided from touching by other member. The power terminals 3 in the preferred embodiment are located on the end walls 122, not on the side walls 121. So the length of the electrical connector 100 in the longitudinal direction is smaller.

The metallic shell 4 is provided with two shielding portions 41 covering on the side walls 121. And each of the shielding portions defines at least one of retaining tails 411 receiving in the base portion 11. The nuts 5 are received in holes 110 defined by ends of the base portion 11 separately to screw the electrical connector 100 on a PCB (Printed Circuit Board).

The mating connector 200 includes a pair of longitudinal side walls 61 and a pair of end walls 62, thereby commonly forming a room. A mating tongue portion 63 upright protrudes to the room so as to define a mating space 64 among the side walls 61, end walls 62 and the mating tongue portion 63. A pair of power terminals 7 are retained in the end walls 62, each of which has a resilient contacting arm 71 projecting into the mating space 64 and facing to one end of the mating tongue portion 63. And a plurality of signal terminals 8 arranged along the mating tongue portion 63. The mating portion 12 is inserted into the mating space 64 and the mating tongue portion 63 is received in the receiving space 10, wherein each guiding post is inserted between the end wall 62 and one end of the mating tongue portion 63 and the power terminals touch each other. Alternatively, the engaging portion 12 of the electrical connector 100 can forms a tongue portion protruding from the base portion 11. The signal terminals arrange in the two side of the tongue portion, and the power terminals retain in the rest two end of the tongue portion.

It is to be understood, however, that even though numerous characteristics and advantages of the present invention have been set forth in the foregoing description, together with details of the structure and function of the invention, the dislosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector comprising:

an insulative housing comprising a base portion and an engaging portion extending from the base portion;

the engaging portion comprising a pair of side walls and a pair of end walls, thereby defining a receiving space;

a plurality of signal terminals arranged along the pair of the side walls; and at least one power terminals located at each end wall;

wherein the end wall defines at least one groove extending along a mating direction at an outside thereof to receive and retain the at least one power terminal;

wherein the at least one power terminal includes a contact portion totally embedded in the corresponding groove without lateral exposure beyond an end face of the end wall;

wherein the at least one groove defines a larger guiding opening at a tip thereof and is divided by a partition portion so as to define a pair of grooves;

wherein the power terminal comprises a contacting portion extending along the mating direction and a mounting portion extending oblique with the contacting portion from the contacting portion; and wherein the contacting portion and the mounting portion of the power terminal are coplanar with each other.

2. The electrical connector as described in claim 1, wherein the end wall defines a cone-shaped guiding portion integrally projecting beyond corresponding edge of the side walls along the mating direction.

3. The electrical connector as described in claim 1, comprising a metallic shell covering on the side walls.

4. An electrical connector assembly comprising:

a first connector including:

a first insulative housing defining opposite first mating face and first mounting face oblique to each other, a first mating port being formed in the housing behind said first mating face;

a plurality of first signal contacts disposed in the first housing and having first contacting sections communicating with said corresponding first mating port in a transverse direction; and at least one first power contact disposed at an end wall of the first housing, and defining a first power contacting section extending perpendicular to said first mating face and a first power mounting section perpendicular to said first mounting face and extending out of the first insulative housing; wherein said first power contact is exposed to an exterior in a longitudinal direction perpendicular to said transverse direction;

wherein the electrical connector assembly further comprises a second connector including:

a second insulative housing defining opposite second mating face and mounting face in a parallel relation with each other, a second mating port formed in the housing behind the second mating face;

a metallic shell covering on the second insulative housing;

a plurality of second signal contacts disposed in the second housing with second contacting sections communicating with the corresponding second mating port in the transverse direction; and at least one second power contact disposed at an end wall of the second housing, wherein the first mating port is coupled to the second mating port under condition of the first signal contacts respectively engaged with the corresponding second signal contacts in the transverse direction while the first power contact engaged the second power contact in the longitudinal direction;

wherein said second power contact is of a resilient type while the first power contact is of a stiff type;

wherein the first power contact faces outward away from the first mating port while the second power contact faces inward toward the second mating port; and wherein said first power mounting section is oblique to the first mating face.

5. The electrical connector assembly as claimed in claim 4, wherein said first mating port is essentially rectangular while a first mounting face thereon, is trapezoidal.

6. The electrical connector assembly as claimed in claim 4, wherein said first connector is further equipped with a pair of metallic shells applied upon a pair of longitudinal sides of the first housing which are essentially perpendicular to the first mating face, and each of said shells defines a mounting leg downwardly extending perpendicular to the first mounting face while being oblique to the first mating face.

7. The electrical connector assembly as claimed in claim 4, wherein said first connector is further equipped with a plurality of mounting feet downwardly extending out of and oblique with regard to the first mounting face while being perpendicular to the first mating face.

8. The electrical connector assembly as claimed in claim 7, wherein said first power mounting section is oblique to said mounting feet.

9. The electrical connector assembly as claimed in claim 7, wherein said first connector is further equipped with a pair of metallic shells applied upon a pair of longitudinal sides of the first housing which are essentially perpendicular to the first mating face, and each of said shells defines a mounting leg downwardly extending perpendicular to the first mounting face while being oblique to said mounting feet.

10. The electrical connector assembly as claimed in claim 9, wherein a distance from a tip of the mounting feet to the first mounting face and that from a tip of the mounting leg to the first mounting face are essentially same with each other.

11. The electrical connector assembly as claimed in claim 7, wherein said mounting feet belong to the first signal contacts.

* * * * *